US009015879B1

(12) United States Patent
Raymond et al.

(10) Patent No.: US 9,015,879 B1
(45) Date of Patent: Apr. 28, 2015

(54) FOLDABLE SOFA MATTRESS AND METHOD

(75) Inventors: Robert A. Raymond, Boca Raton, FL (US); W. Clark Rogers, Jr., New London, NC (US)

(73) Assignee: Axess Direct, Inc., Asheboro, NC (US)

( * ) Notice: Subject to any disclaimer, the term of this patent is extended or adjusted under 35 U.S.C. 154(b) by 0 days.

(21) Appl. No.: 13/470,458

(22) Filed: May 14, 2012

(51) Int. Cl.
*A47C 17/22* (2006.01)
*A47C 23/00* (2006.01)

(52) U.S. Cl.
CPC ..... *A47C 17/225* (2013.01); *A47C 23/005* (2013.01)

(58) Field of Classification Search
CPC ..... A47C 17/02; A47C 17/04; A47C 17/045; A47C 17/132; A47C 17/225; A47C 23/005
USPC ..... 5/12.1, 13, 1, 2.1, 35, 249, 255, 719, 5/716
See application file for complete search history.

(56) References Cited

U.S. PATENT DOCUMENTS 4,192,032 A * 3/1980 Geraci ..... 5/497
4,377,279 A 3/1983 Schulz, Jr. et al. ..... 267/103
4,654,905 A * 4/1987 Miller ..... 5/249
4,811,932 A 3/1989 Miller ..... 267/95
5,257,424 A * 11/1993 Rogers ..... 5/13
5,364,082 A 11/1994 Miller ..... 267/108
5,524,305 A 6/1996 Miller ..... 5/267
5,535,460 A 7/1996 Miller ..... 5/269
5,539,940 A 7/1996 Miller ..... 5/13
5,539,944 A * 7/1996 Miller ..... 5/716
5,540,418 A 7/1996 Miller ..... 267/95
5,551,104 A * 9/1996 Hartline ..... 5/13
5,642,536 A 7/1997 Miller ..... 5/13
5,655,240 A 8/1997 Miller ..... 5/717
5,745,935 A * 5/1998 Arft ..... 5/13
5,964,453 A * 10/1999 McCraw ..... 267/103
6,012,190 A * 1/2000 Rogers ..... 5/722
7,487,564 B2 2/2009 Miller ..... 5/716
7,726,636 B2 6/2010 Miller ..... 267/144
7,979,930 B2 * 7/2011 Miller ..... 5/2.1
8,201,290 B1 * 6/2012 Hooley et al. ..... 5/35

OTHER PUBLICATIONS

Co-pending U.S. Appl. No. 13/470,478, filed May 14, 2012.

* cited by examiner

*Primary Examiner* — Peter M Cuomo
*Assistant Examiner* — Brittany Wilson
(74) *Attorney, Agent, or Firm* — Blake P. Hurt

(57) ABSTRACT

A foldable sofa mattress and method for storing within low profile furniture. The mattress includes a transition section disposed between different collapsible sinuous spring sections. The sinuous spring sections are pivotably joined to the transition section and the sections are affixed to upper and lower grids for support. A method for storing a foldable mattress includes the steps of providing a mattress with a transition section disposed between two collapsible sections, extending opposing pairs of straps from the transition section to each of the separate collapsible sections, and bending the mattress. The method further includes the steps of flattening the two collapsible sections, placing the flattened sections on top of one another, and storing the folded mattress in a cavity.

17 Claims, 7 Drawing Sheets

FOLDABLE SOFA MATTRESS AND METHOD

FIELD OF THE INVENTION

The invention herein pertains to mattresses generally and particularly pertains to a foldable mattress with coiled and sinuous springs that can be stored in furniture by collapsing sections of the mattress to reduce its height when not in use.

DESCRIPTION OF THE PRIOR ART AND OBJECTIVES OF THE INVENTION

Foldable beds, particularly folding beds which are stored within other furniture, are an attractive bedding option for consumers with restricted living space. Typically a foldable mattress bends upon itself either one or two times for easy storage, then unfolds into a bed. The bed generally includes a mattress that is sufficiently flexible to fold upon itself and a frame which serves as both the supporting bed frame and a restraining unit for the mattress in its folded posture. The frame includes a body section pivotally attached at one end to the end of a cavity section within a given piece of furniture. The opposite end of the frame is usually folded into a seat section. These sections are serially aligned horizontally in the unfolded position and are bended upon one another such that the body section and seat section are substantially parallel to one another and are perpendicular to the cavity section. The frame is often mounted in an upholstered sofa or chair frame into which the bed frame and mattress are folded and stored when not in use. Cushions can then be placed upon the folded mattress for use as a sofa or chair.

To date, foldable mattresses have exhibited a number of shortcomings. One area of dissatisfaction is the sleeping comfort of the mattress. For storage purposes, it is desirable that the mattress fold into the thinnest structure possible. The need for a compactly folded mattress is particularly important if the mattress and frame are attached to a sofa or chair, since the mattress and frame must fit within the sofa or chair, which often impose style or ergonomic restrictions. Thick, firm mattresses that would provide optimal sleeping comfort are often too bulky to be folded into the space available in many sofa or chair styles, in particular, transitional and contemporary styles which often have either a low seat height or an "off-the-floor" front profile which limits the space available in which to store a bed. This "low profile" design generally refers to furniture that is smaller in overall size or lower to the ground than traditional pieces and has recently become popular in the furniture market. Conventional sofas have addressed the size constraint by employing a mattress that is either thin and easily folded, soft and easily crushed, or a combination of each, utilizing materials such as foam or down in addition to springs for support. The result is often unsatisfactory and uncomfortable for a sleeping surface.

Attempts have been made to address the aforementioned problem. One solution has been the development of "collapsible" sinuous springs that comprise some or all of the supporting springs in the mattress. These sinuous springs are generally planar and are pivotally interconnected at each end to a pair of wire grids that are adjacent and parallel with the upper and lower upholstery faces of the mattress. Sinuous springs can be oriented parallel with the head and foot end faces of the mattress and orthogonal to the upper, lower, and lateral faces of the mattress. When the bed is in its unfolded posture, the springs are substantially upright. However, as the bed moves to its folded position, the springs pivot about the wires comprising the grid so that the mattress upper surface is drawn closer and shifts longitudinally relative to the mattress lower surface. As a result, the distance between the upper and lower mattress surfaces (i.e., the thickness of the mattress) is significantly decreased, thereby giving the mattress the appearance of having "collapsed". Examples of collapsible springs suitable for use in foldable bedding are illustrated in U.S. Pat. No. 5,539,944 to Miller and U.S. Pat. No. 5,257,424 to Rogers. This concept of "collapsible" is not to be confused with the term "flexible" which refers to the ability to bend without breaking. Despite the success of these designs, the mattresses that result from these spring configurations do not collapse to a sufficient degree to allow storage in contemporary "low profile" furniture designs while simultaneously providing a stable and comfortable sleeping surface.

The grid wires which the springs are attached also present problems. The springs are generally attached to the grid wires either by a clip that encircles the grid wire and spring run, or by a helical wire. The grid wires, which extend laterally (i.e., from one side to the mattress to the other), intersect perpendicularly with extending linked portions that extend longitudinally (i.e. from head to foot). These structures typically provide a more stable sleeping surface but have reduced the overall flexibility of the mattress design. Therefore, it is desirable to design a foldable mattress that utilizes the structural aspects of a grid but that joins sections of the grid together at points that pivot so as to facilitate easy and efficient folding and storage.

Thus, in view of the problems and disadvantages associated with prior art mattresses, the present invention was conceived and one of its objectives is to provide a sleeper sofa that contains a comfortable and stable foldable mattress upon which to sleep or rest.

It is another objective of the present invention to provide a compact foldable mattress which will fit into a chair or sofa with a "low profile" design.

It is still another objective of the present invention to provide a foldable mattress with a transition section that anchors other sections of the mattress when it is unfolded.

It is yet another objective of the present invention to provide a transition section that can anchor other sections of a foldable mattress when in an erect position during use while also allowing the same sections to collapse for more efficient storage.

It is a further objective of the present invention to provide a biasing strap that is connected to other sections of a foldable mattress to assist in maintaining sinuous springs in their erect posture while also preventing vertical displacement of the transition section when the mattress is in use.

It is still a further objective of the present invention to provide a foldable mattress that includes two separate sections that can decrease their respective heights during storage.

It is yet a further objective of the present invention to provide a brace assembly to provide structural stability to the transition section of a foldable mattress that is also comfortable to sleep thereon.

It is another objective of the present invention to provide a sleeper sofa mattress that may be stored in a smaller space than traditional sleeper sofa mattresses for ease in handling and shipping.

It is still another objective of the present invention to provide a foldable mattress that is easily manufactured on a large scale while retaining a low cost.

It is yet another objective of the present invention to provide a foldable mattress with coil springs in a pivotable first section.

Various other objectives and advantages of the present invention will become apparent to those skilled in the art as a more detailed description is set forth below.

SUMMARY OF THE INVENTION

The aforesaid and other objectives are realized by providing a foldable mattress made of separate spring sections that are pivotably joined to provide a comfortable and stable sleeping surface while also reducing the conventional spatial storage requirements of such a mattress. The mattress includes a pair of sections including collapsible sinuous springs and coil springs with a transition section disposed therebetween. Straps are used to maintain the upright posture of the attached sections of collapsible sinuous springs when the mattress is unfolded and in use in its horizontal position while simultaneously preventing the brace assemblies within the transition section from displacing vertically and creating an uncomfortable resting surface for a user.

A method for storing the foldable mattress is also provided and includes the steps of providing a mattress with a transition section disposed between two collapsible sections, extending a pair of straps from the transition section to each of the separate collapsible sections, and bending the mattress. The method further includes the steps of flattening the two collapsible sections, placing the flattened sections in coincidental relation, and storing the collapsed, folded mattress in a cavity.

DETAILED DESCRIPTION OF THE PREFERRED EMBODIMENT AND OPERATION OF THE INVENTION

Figure 2:
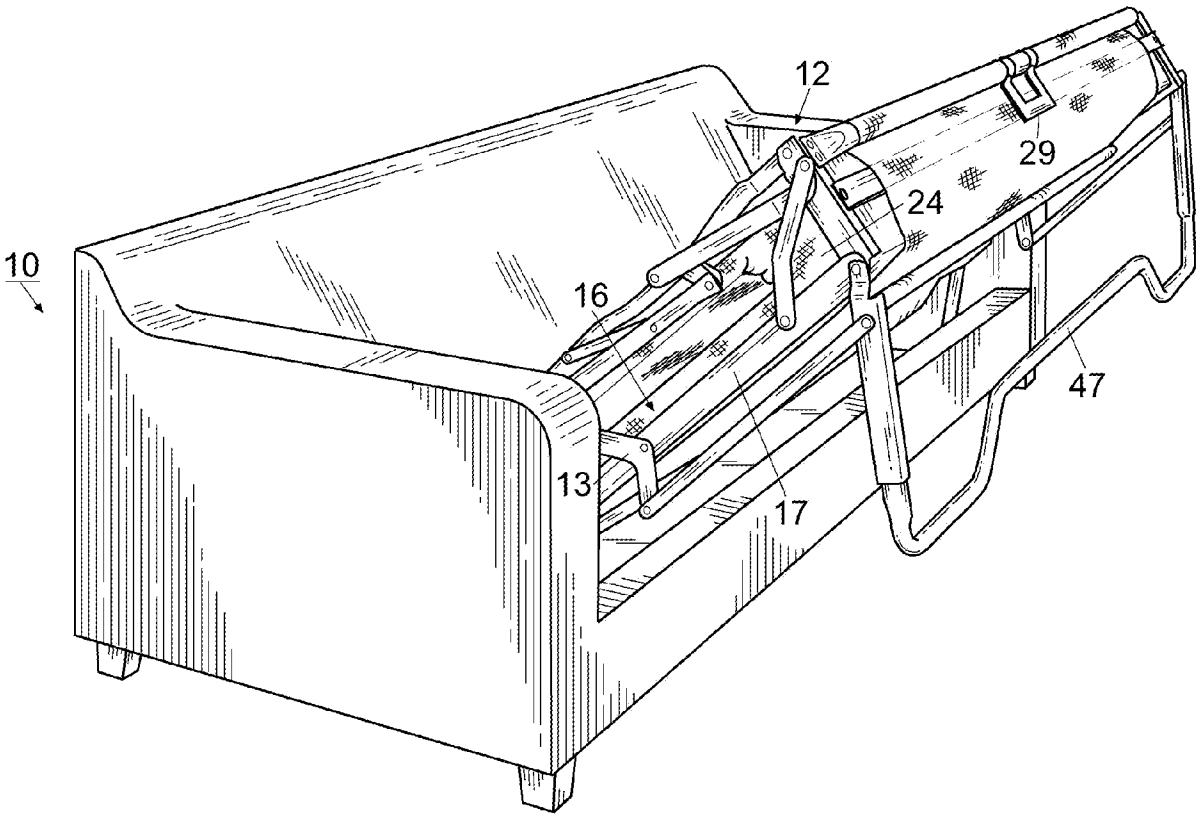
FIG. 2 features a schematic perspective view of the partially unfolded sofa bed seen in FIG. 1.
Figure 3:
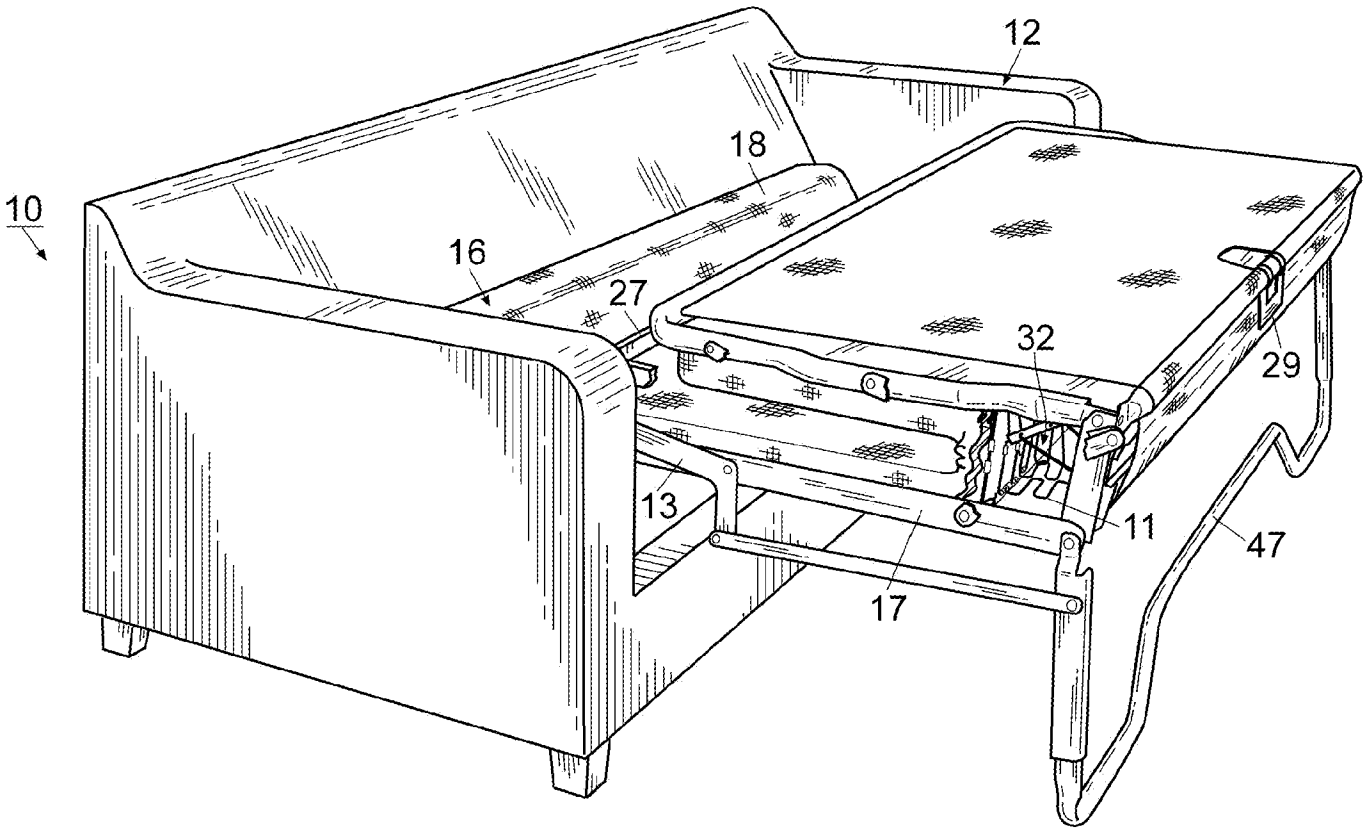
FIG. 3 depicts a schematic perspective view of the sofa bed approximately unfolded 50%.
Figure 4:
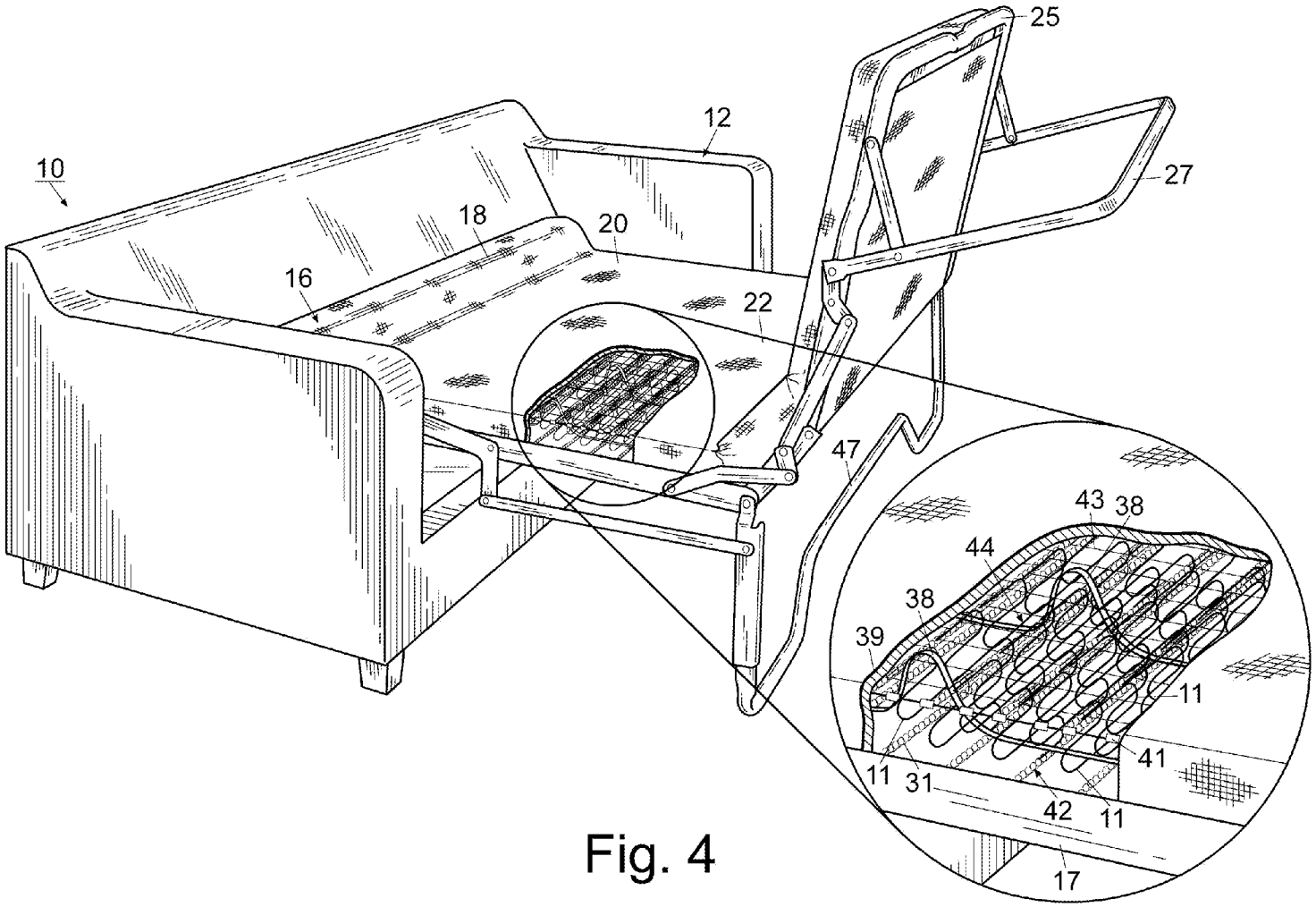
FIG. 4 demonstrates a schematic perspective view of the sofa bed of FIG. 3 further unfolded.
Figure 5:
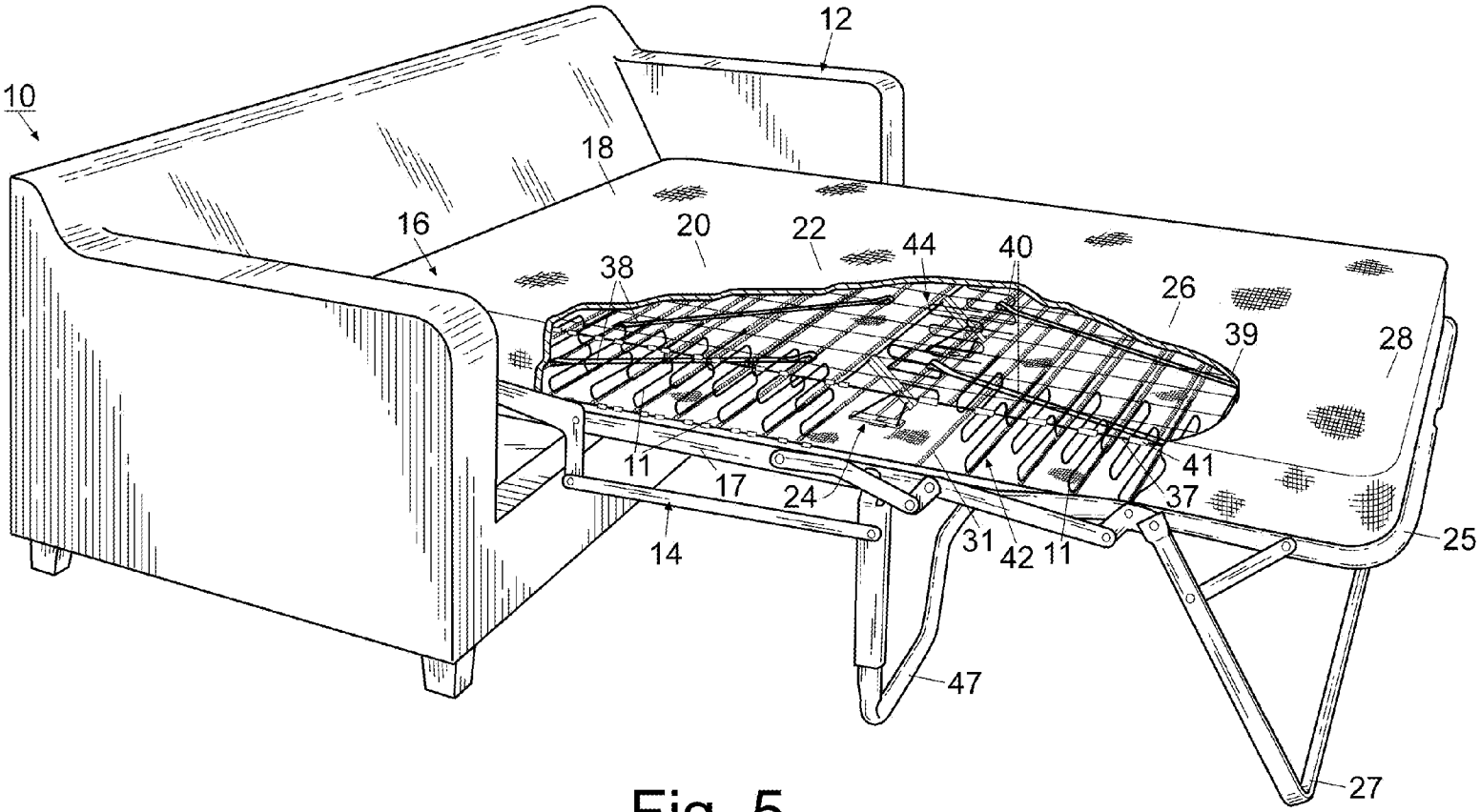
FIG. 5 illustrates in schematic perspective representation the fully unfolded sofa bed.
Figure 6:
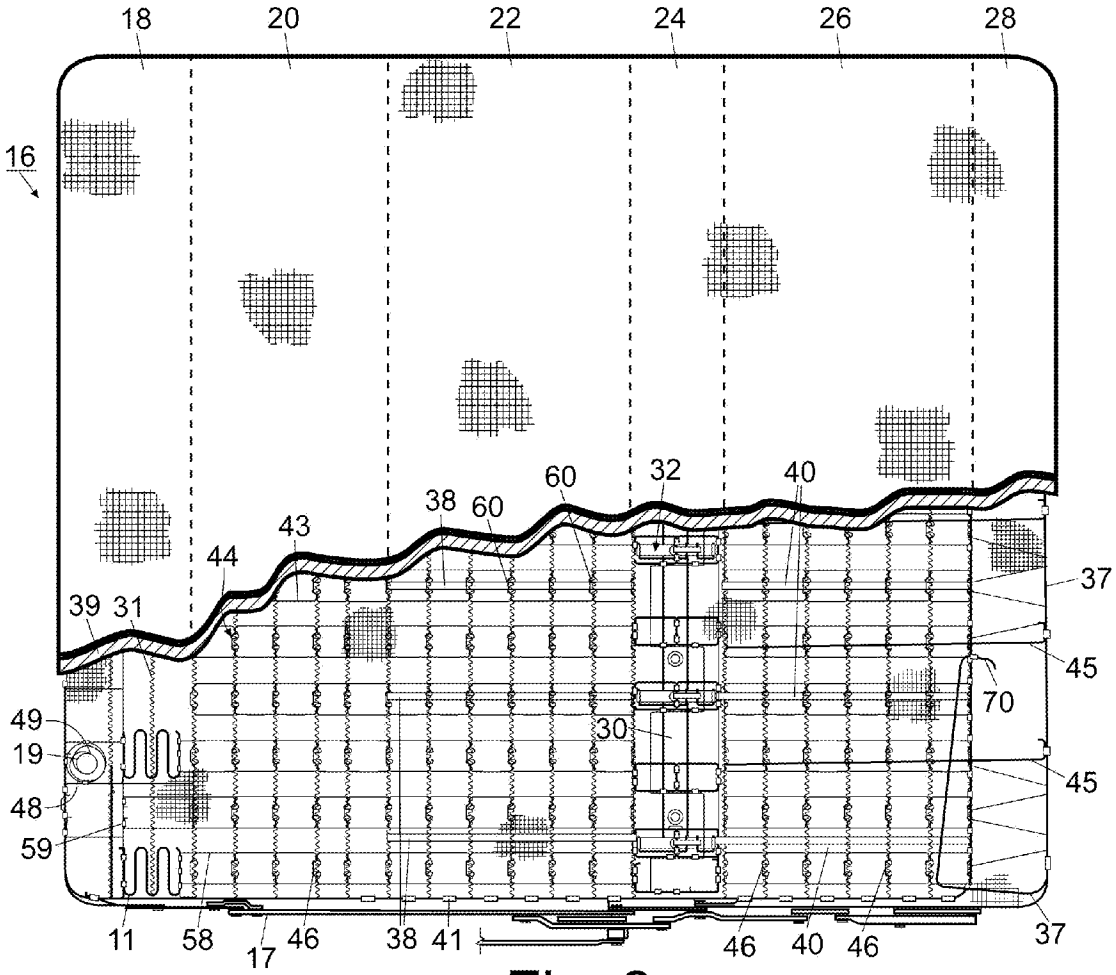
FIG. 6 pictures a top plan view of the foldable mattress as seen in FIG. 5 as removed from the sofa with a portion of the padding cut-away to reveal certain of the spring structures thereunder.
Figure 7:
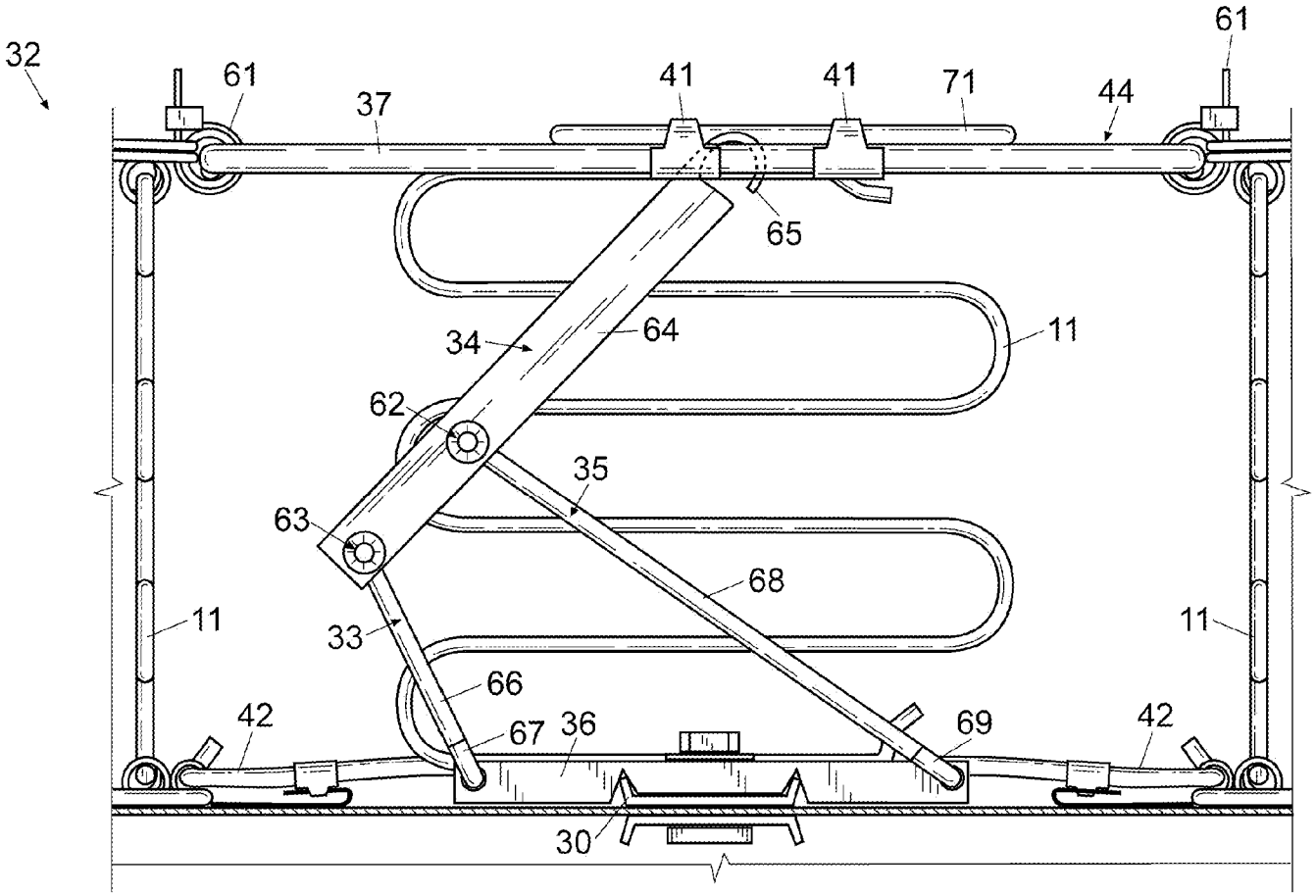
FIG. 7 shows a magnified view of a brace assembly of the foldable mattress depicted in FIG. 5.

For a better understanding of the invention and its operation, turning now to the drawings, the preferred embodiment of foldable mattress 16 is seen in FIGS. 1-6 with sleeper sofa and further includes sleeper sofa frame 12 which secures foldable mattress 16 with frame rails 17 (FIGS. 2-3), head cross member 23 (FIG. 1) and foot cross member 25 (FIG. 4). Preferred foldable mattress 16 as seen in FIGS. 5 and 6 is made up of first mattress section 18 having coil springs 19, second mattress section 20 having collapsible sinuous springs 11, third mattress section 22 which also includes collapsible sinuous springs 11, transition section 24 having brace assembly 32, fourth mattress section 26 which also includes collapsible sinuous springs 11, and mattress foot section 28. As seen in FIG. 7, transition section 24 further includes support member 30 and plate 36 to anchor brace assembly 32 to foldable mattress 16 while distal hook 34 engages upper grid 44.

Figure 1:
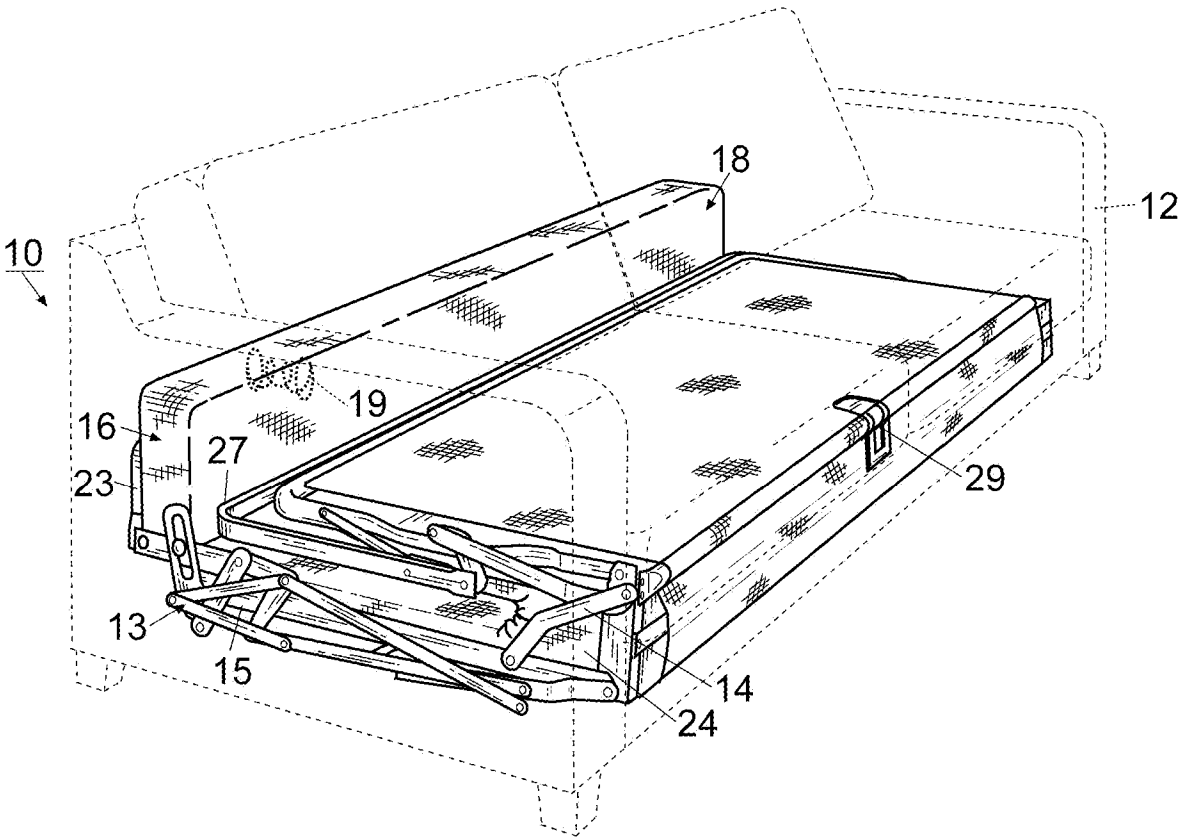
FIG. 1 shows in schematic representation a perspective view of a fully retracted sofa bed within a sofa shown in broken lines.

FIG. 1 schematically illustrates preferred sleeper sofa 10 with foldable mattress 16 affixed to foldable bed frame 14 and stored in a folded configuration within sleeper sofa frame 12. Sofa frame 12 is shown un-upholstered but as understood fabric or padding (not shown) would be added for comfort and design aesthetics. Although sleeper sofa 10 and sofa frame 12 are displayed as a conventional two cushion sofa, those skilled in the art will appreciate that sleeper sofa 10 may take the form of a variety of furniture pieces configured to store foldable mattress 16 for example love seats, sectional sofas, and chairs. Further, in the folded position foldable bed frame 14 and foldable mattress 16 are generally horizontal, with first mattress section 18 and transition section 24 (see FIGS. 1, 2 and 4) oriented vertically. When in this folded posture first mattress section 18 of mattress 16 is maintained vertically within an internal cavity (not shown) behind the back cushions (not shown) of sofa frame 12. This vertical orientation allows foldable mattress 16 and foldable bed frame 14 to be slightly longer than conventional sofa mattresses while retaining its reduced spatial storage footprint. FIG. 1 also pictures an example of helical coil spring 19 which is the preferred spring type in first mattress section 18 because coil spring 19 has superior structural support capabilities in such use over sinuous springs 11 although other types of resilient members may also be used.

FIG. 2 is a schematic perspective representation of sleeper sofa 10 in a partially unfolded orientation. After removing the seat cushions (shown in dotted line in FIG. 1) from sleeper sofa 10, an upward directed force is applied to mattress handle 29 causing simultaneous movement at foldable bed frame 14 and foldable mattress 16. Although not shown during this movement first mattress section 18 is being withdrawn from within sofa frame 12. A pair of opposing mounting rails 15 (only one shown in FIG. 1) are longitudinally mounted to the interior of sofa frame 12 and provide an attachment platform for extension mechanism 13 (FIG. 3) that controls the extension and retraction of foldable bed frame 14 within sofa frame 12. Extension mechanism 13 is a conventional assembly known in the art as seen in U.S. Pat. No. 5,257,424 and is pivotably connected to mounting rails 15 and frame rails 17 (only one shown), allowing foldable bed frame 14 to pull out from storage within sofa frame 12. Frame rails 17 may be generally L-shaped and support the lateral edges of foldable mattress 16 from beneath and extend upwardly therefrom to prevent lateral displacement of foldable mattress 16.

Foldable bed frame 14 has serially and pivotally interconnected sections of frame rails 17 to support first mattress section 18, second mattress section 20, third collapsible sinuous spring section 22, transition section 24, fourth collapsible sinuous spring section 26, and foot section 28. Foldable bed frame 14 moves between an unfolded and generally horizontal position (FIG. 5) where first, second, third, transition, fourth, and foot sections 18, 20, 22, 24, 26, and 28, respectively, are horizontally disposed, and a folded position (FIG. 1) in which second, third, fourth, and foot sections 20, 22, 26, and 28, respectively, are coincidentally horizontal, with fourth section 26 and foot section 28 overlaying second section 20 and third section 22 while first section 18 and transition section 24 are generally upright and stored within sofa frame 12. The pairs of frame rails 17 making up each side of bed frame 14 are mirror images of one another and any description applying to one side is equally applicable to the opposite side.

In addition to having a pair of frame rails 17, first mattress section 18 further includes cross member 23 (FIG. 1) which connects frame rails 17 of mattress section 18 and defines the terminal head of foldable bed frame 14. Similarly, foot section 28 includes cross member 25 (FIG. 4) that interconnects frame rails 17 and defines the terminal foot of foldable bed frame 14. Although head and foot cross members 23 and 25 may be constructed in a general L-shape similar to frame rails 17, preferable head and foot cross members 23 and 25 are formed of tubular construction so as to encase foldable mattress 16 to prevent longitudinal or lateral displacement. The other hardware and structural components of foldable bed frame 14 are known in the art and will therefore not be described in detail herein. An exemplary foldable bed frame is illustrated in U.S. Pat. No. 5,539,944 incorporated by reference herein.

First mattress section 18 includes a plurality of conventional Bonnell-type helical coil springs 19 (only one shown in FIGS. 1, 6) which are arranged in a transverse row. Coil springs 19 are oriented so that the longitudinal axis of each helix is generally upright when mattress 16 is fully extended as seen in FIG. 5. As seen in FIG. 6, coil top 48 of coil spring 19 is attached to upper grid 44 while coil bottom 49 is affixed to lower grid 42. As also seen in FIGS. 5 and 6, both grids 42 and 44 are made up of grid wires 43 and bisecting helical wires 31. As further seen in FIG. 6 grid wires 43 may include continuous wire segment 58 that originates in hook 59 and runs longitudinally defining the top of foldable mattress 16. Grid wires 43 are fastened to border wires 37 proximate head cross member 23 and foot cross member 25 of foldable mattress 16 and further includes tongue portion 46 that extends perpendicular to grid wire 43. Tongue portion 46 forms two-way loop 60 configured to receive helical wire 31. Coil springs 19 may be attached to upper grid 44 or lower grid 42 in any manner, for example with fasteners 41 (FIG. 6), wire ties 61 (FIG. 7) or adhesives (not shown). First mattress section 18 further includes a plurality of horizontally and vertically disposed sinuous springs 11 arranged in transverse rows, as seen in FIGS. 5 and 6. Pairs of opposing vertically mounted sinuous springs 11 are affixed to upper grid 44 and lower grid 42 on each side of each coil spring 19 while a series of horizontally mounted sinuous springs 11 are affixed to upper grid 44 only in perpendicular fashion to cross member 23.

A perspective representation of an about half unfolded sleeper sofa 10 is depicted in FIG. 3 with support leg 47 fully extended and foldable mattress 16 still folded over with foot section 28 and fourth collapsible sinuous spring section 26 in a collapsed, somewhat flattened posture overtop second mattress section 20 and third collapsible sinuous spring section 22 which are also in a collapsed, somewhat flattened posture. First mattress section 18 is shown removed from within sofa frame 12 and helical coil springs 19 are in a somewhat vertical posture prior to complete unfolding of mattress 16. Second mattress section 20 also includes a plurality of vertically disposed collapsible sinuous springs 11 arranged in transverse rows. Collapsible sinuous springs 11 are attached to grid wires 43 and helical wires 31 of upper grid 44 and lower grid 42 in a substantially similar manner as helical coil springs 19 described in first mattress section 18. Second mattress section 20 is pivotally connected to first mattress section 18 which allows the two sections 18 and 20 to pivot and flex independently. This feature is important when storing foldable mattress 16 as first mattress section 18 does not collapse upon storage within sleeper sofa frame 12 and remains generally vertical as seen in FIG. 1 within sofa frame 12 while second mattress section 20 collapses to change from a vertical posture to lay mostly in a horizontal posture when being stored. Second mattress section 20 may also flex about sleeper sofa frame 12 which may increase the configurations available for storing foldable mattress 16 without increasing the spatial requirements.

Each of collapsible sinuous springs 11 is essentially identical to every other collapsible sinuous spring 11 in mattress 16. Therefore, only one sinuous spring 11 will be referred to in this description although one skilled in the art will appreciate that the description is equally applicable to all other collapsible sinuous springs 11. Collapsible sinuous spring 11 is a conventional spring that is well known in the art, for example as shown in U.S. Pat. No. 5,539,940 incorporated by reference herein.

FIG. 4 illustrates third mattress section 22 consisting of a plurality of rows of a plurality of vertically positioned collapsible sinuous springs 11 and a plurality of first straps (FIG. 6) spaced and positioned in a transverse row therealong. Each of first straps 38 are attached at one end to upper grid 44 proximate the upper portion of transition section and at the other end to lower grid 42 proximate the intersection of third mattress section 22 and second mattress section 20 as seen in FIG. 6. Specifically, first strap 38 is connected to border wire 37 which is a heavier gauge wire than grid wires 43 and runs about the top periphery of each of mattress sections 18, 20, 22, 24, 26, and 28 while providing structural stability to foldable mattress 16 generally and sinuous springs 11 specifically. As seen in FIGS. 5 and 6 fourth mattress section 26 consists of a plurality of lateral rows of a plurality of vertically positioned collapsible sinuous springs 11 and a plurality of second straps 40 spaced and positioned in a transverse row therealong. Each of second straps 40 are attached at one end to upper grid 44 proximate the upper portion of transition section 24 on the opposite side in relation to first straps 38 and at the other end to helical wires 31 of lower grid 42 that are disposed at the edge of fourth mattress section 26 closest to mattress foot section 28. Second straps 40 are in opposing relation to first straps 38 for equality in support as tension is applied and released during operation of sleeper sofa 10.

As foldable mattress 16 unfolds from a stored position (FIG. 1), collapsible sinuous springs 11 in each of second mattress section 20 and third mattress section 22 transition from a flattened, horizontal or collapsed position as seen in FIGS. 1 and 3 to a more vertical, erect position as seen in FIG. 5. Likewise collapsible sinuous springs 11 of fourth mattress section 26 shift from a flattened, horizontal or collapsed position to a more vertical, erect position. This movement is mirrored by upper grid 44 pivoting at the interconnection of grid wires 43 and helical wires 31 and shifting longitudinally while foldable bed frame 12 remains largely stationary and stable.

In FIG. 4 as the unfolding of foldable bed frame 14 and foldable mattress 16 progresses, support leg 27 extends outwardly as transition section 24 is moved from a vertical posture as seen in FIG. 1 to a horizontal posture as seen in FIG. 5 and continues to provide support as collapsible sinuous springs 11 in each of mattress sections 20, 22 and 26 rise into a substantially vertical orientation. Transition section 24 preferably includes U-shaped support member 30 as seen in FIG. 7 affixed laterally to the bottom of foldable mattress 16. Support members 30, 30' are preferably made of a metal such as steel to withstand the directional forces exerted by first straps 38 and second straps 40, which are used to maintain collapsible sinuous springs 11 of second section 20, third section 22, and fourth mattress section 26 in an erect position when foldable bed 16 is fully horizontal as seen in FIGS. 5 and 6.

Support member 30 also serves as an anchor point for brace assembly 32 shown in FIG. 7 which may provide lumbar support to a user of sleeper sofa 10 as well as additional structural support to brace against first straps 38 and second straps 40 which prevent brace assembly 32 from displacing in an upward direction from support member 30. Brace assembly 32 can be formed with proximal hook 33, distal hook 34, and intermediate hook 35. Distal hook 34 preferably has tubularly constructed body 64 defining a pair of apertures 62, 63 proximate one end and terminates at the opposing end in hook 65 that engages rectangular panel wires 71 of upper grid 44. Proximal hook 33 has shaft body 66 that terminates in hook 67 which attaches to an aperture (not shown) on one end of plate 36 that is affixed to support member 30. The opposing end of proximal hook 33 forms an angle (not shown) and passes through lowermost aperture 63 of distal hook 34. A spacer (not shown) may also be fitted into apertures 62, 63 to prevent any unnecessary rotation and flexing in brace assembly 32. Intermediate hook 35 has the same construction as proximal hook 33 but includes longer shaft body 68 which terminates into hook 69 that attaches to an aperture (not shown) on the opposite end of plate 36. Intermediate hook 35 also forms an angle (not shown) and passes through upper aperture 62 in distal hook 34. Although hooks 33, 34, and 35 do flex when compressed by the bodyweight of a user (not shown), brace assembly 32 remains generally fixed during the folding and storage of foldable mattress 16.

A perspective view of a schematic representation of fully unfolded sleeper sofa 10 is illustrated in FIG. 5 with support legs 27 and 47 fully extended. Foldable mattress 16 is shown fully removed from its stored position within sofa frame 12 (FIG. 1) and all mattress sections 18, 20, 22, 24, 26, and 28 are generally horizontal. In this configuration, all collapsible sinuous springs 11 have been rotated upright and are now substantially vertical. During use, this posture is maintained with assistance from first and second straps 38 and 40 which prevent sinuous springs 11 from collapsing under the weight of a user (not shown).

Also displayed in FIG. 5 is support leg 27 which is pivotally attached to foldable bed frame 14. Support leg 27 may consist of a tubular construction and adds structural support to the foot end of foldable mattress 16 opposite sleeper sofa frame 12. Support leg 27 further provides a grip for users who are unfolding sleeper sofa 10 and pivots up and adjacent in a generally parallel position relative foldable bed frame 14 and to the bottom of lower grid 42 when foldable mattress 16 is stored within sleeper sofa frame 12. However, when foldable mattress 16 is unfolded from its stored position, support leg 27 pivots down into a generally perpendicular position to support weight placed on the distal half of mattress 16. Second support leg 47 is also attached to foldable bed frame 14 and consists of the same general construction as support leg 27 (FIG. 4). Second support leg 47 is positioned approximately equidistant from cross member 23 proximate the head of mattress 16 and cross member 25 proximate the foot of foldable mattress 16 and extends the width of mattress 16. Second support leg 47 is generally centrally located to support the weight of a user of foldable mattress 16.

FIG. 6 features a top plan view of foldable mattress 16 with a portion of padding 39 removed to reveal the various springs 11, 19 and other components that make up its structure. Also visible in FIG. 6 is foot section 28 that is pivotally carried by fourth mattress section 26 which allows foot section 28 to collapse in tandem with fourth mattress section 26. In addition to fourth mattress section 26, foot section 28 is supported by a plurality of support stems 45 that extend from the exterior border wire 37 of upper grid 44 of foot section 28 to helical wires 31 of lower grid 42 proximate the joining of transition section 24 and fourth mattress section 26. Support stems 45 propel foot section 28 from fourth mattress section 26 and provide added stiffness for the foot terminus of unfolded mattress 16. Although border wires 37 provide an attachment for support stems 45, they do not define a completed top section of foot section 28 as is the case in other sections (see first mattress section 18 for an example) and instead terminate in slightly curved end 70 located towards the center of foldable mattress 16.

Also visible in FIG. 6 are fasteners 41 that allow the sections of foldable mattress 16 to pivotally join together. Fasteners 41, together with the corresponding pivots (not shown) in foldable bed frame 14 permit foldable mattress 16 to fold into coincidental orientation and, together with collapsible sinuous springs 11 are responsible for foldable mattress 16 to be stored in a lower profile piece of furniture than conventional sleeper sofa mattresses. In the preferred embodiment, mattress 16 may be stored in a furniture cavity that is as little as eight inches (8") deep.

FIG. 7 also illustrates sinuous spring 11 which is not a component of brace assembly 32 but is also positioned within transition section 24. Whereas sinuous springs 11 that make up collapsible sinuous spring sections 20, 22, and 26 are coiled laterally (i.e. the "long" section of the spring runs across the width of the mattress), sinuous springs 11 that are positioned in transition section 24 are coiled longitudinally (i.e. they are oriented perpendicular to the springs in the sections 20, 22, and 26) to assist in rigidity of transition section 24.

The preferred method for storing foldable mattress 16 includes providing a foldable mattress 16 with a transition section 24 disposed between two collapsible sections 22, 26, extending a plurality of first and second straps 38, 40 in opposing relation from transition section 24 to respectively each of the separate collapsible sections 22, 26, and bending the foldable mattress 16. The preferred method further includes flattening the two collapsible sections 22, 26, placing the flattened sections 22, 26 on top of one another, and storing the foldable mattress 16 within a sofa frame 12. The preferred method also includes providing a support member 30 and brace assembly 32 comprising distal hook 34 attached to upper grid 44 and proximal hook 33 attached to plate 36 carried by support member 30.

The illustrations and examples provided herein are for explanatory purposes and are not intended to limit the scope of the appended claims.

We claim:

1. A sleeper sofa comprising: a sofa frame, a foldable bed frame, said foldable bed frame attached to said sofa frame, a foldable mattress, said foldable mattress affixed to said bed frame, said foldable mattress comprising a first section, said first section comprising a coil spring and a sinuous spring, a second section, said second section comprising a collapsible sinuous spring and joined to said first section, a third section, said third section comprising a collapsible sinuous spring, said second section pivotally joined to said third section, a noncollapsible mattress transition section, a fourth section, said fourth section comprising a collapsible sinuous spring, said transition section disposed between and directly pivotally attached to said third section and said fourth section, a foot section, said foot section attached to said fourth section whereby said foldable bed frame and said foldable mattress can be folded within said sofa frame with at least said third and fourth sections collapsing in parallel orientation while said transition section remains erect.

2. The foldable mattress of claim 1 further comprising an upper grid, said coil spring further comprising a top and a bottom, said top affixed to said upper grid.

3. The foldable mattress of claim 2 further comprising a lower grid, said lower grid attached to said bottom.

4. The foldable mattress of claim 1 whereby said sinuous spring of said first mattress section is oriented transversely relative to said foldable mattress.

5. The sleeper sofa of claim 1 defining a noncollapsible transition section without a helical coil spring therein.

6. A foldable mattress comprising a lower grid, a first mattress section, said first section comprising a coil spring and a sinuous spring, each disposed within said first section, a second mattress section, a third mattress section, said second and third mattress sections each comprising a collapsible sinuous spring, a noncollapsible transition section, said second and third mattress sections opposingly and pivotably joined to said transition section, said mattress sections and said transition section affixed to said lower grid, whereby said mattress is configured to be stored within a sofa cavity less than ten inches high, and whereby said second and third mattress sections collapse in parallel orientation while said noncollapsible transition section remains erect.

7. The foldable mattress of claim 6 further comprising an upper grid, said coil spring further comprising a top and a bottom, said top affixed to said upper grid.

8. The foldable mattress of claim 7 further comprising a lower grid, said lower grid attached to said bottom.

9. The foldable mattress of claim 6 whereby said sinuous spring of said first mattress section is oriented transversely relative to said foldable mattress.

10. The foldable mattress of claim 6 defining a noncollapsible transition section without a helical coil spring therein.

11. A method for storing a foldable mattress comprising the steps of:

a) providing a mattress with a noncollapsible transition section disposed between two collapsible sections and a coil spring and sinuous spring positioned within a vertically oriented first mattress section;

b) exerting an upward force on the unattached end of the mattress;

c) bending the mattress;

d) flattening the two collapsible sections while the first section and the transition section remains erect;

e) placing the flattened sections in coplanar relation;

f) pivoting the first mattress section and coil spring within into a generally horizontal configuration; and g) storing the folded mattress in a cavity.

12. The method of claim 11 further comprising the step of providing a coil spring that is attached at a top to an upper grid.

13. The method of claim 12 further comprising the step of providing a coil spring that is attached at a bottom to a lower grid.

14. The method of claim 13 wherein the step of providing a coil spring that is attached to an upper and lower grid further comprising the step of fastening said coil spring to said upper and lower grids with fasteners.

15. The method of claim 11 wherein the step of providing a sinuous spring positioned within said first mattress section further comprises the step of providing a sinuous spring which is oriented transversely relative to said foldable mattress.

16. The method of claim 15 wherein the step of storing the mattress in a cavity further comprises the step of storing said folded mattress in a furniture cavity eight inches high.

17. The method of claim 11 wherein the step of providing a mattress with a noncollapsible transition section further comprises defining a noncollapsible transition section without a helical coil spring therein.

* * * * *